US005174790A

United States Patent [19]

Riggins et al.

[11] Patent Number: 5,174,790

[45] Date of Patent: Dec. 29, 1992

[54] EXHAUST PROCESS FOR DYEING AND/OR IMPROVING THE FLAME RESISTANCE OF ARAMID FIBERS

[75] Inventors: Phillip H. Riggins; Barbara J. Cates, both of Greensboro, N.C.

[73] Assignee: Burlington Industries, Greensboro, N.C.

[21] Appl. No.: 582,396

[22] Filed: Sep. 13, 1990

Related U.S. Application Data

[63] Continuation-in-part of Ser. No. 437,397, Nov. 16, 1989, abandoned, which is a continuation-in-part of Ser. No. 295,001, Jan. 9, 1989, Pat. No. 4,898,596, which is a continuation of Ser. No. 139,761, Dec. 30, 1987, abandoned.

[51] Int. Cl.[5] ..... D06M 13/298; D06P 1/90; D06P 3/24; D06P 5/06

[52] U.S. Cl. ..... 8/490; 8/572; 8/130.1; 8/925; 428/272; 428/920

[58] Field of Search ..... 8/130.1, 925, 490, 572; 428/920, 272

[56] References Cited

U.S. PATENT DOCUMENTS

| | | | |
|---|---|---|---|
| 4,705,523 | 11/1987 | Hussamy | 8/465 |
| 4,710,200 | 12/1987 | Cates et al. | 8/130.1 |
| 4,741,740 | 5/1988 | Davis et al. | 8/130.1 |
| 4,749,378 | 1/1988 | Cates et al. | 8/130.1 |
| 4,759,770 | 7/1988 | Cates et al. | 8/130.1 |
| 4,762,522 | 8/1988 | Maue | 8/94.19 |
| 4,780,105 | 10/1988 | White et al. | 8/925 |
| 4,812,140 | 3/1989 | Russell et al. | 8/130.1 |
| 4,814,222 | 3/1989 | Davis et al. | 8/130.1 |
| 4,898,596 | 2/1990 | Riggins et al. | 8/130.1 |
| 4,981,488 | 1/1991 | Cates et al. | 8/925 |

FOREIGN PATENT DOCUMENTS

| | | |
|---|---|---|
| 1275459 | 5/1972 | United Kingdom . |

*Primary Examiner*—James C. Cannon
*Attorney, Agent, or Firm*—Nixon & Vanderhye

[57] ABSTRACT

Aramid and aramid-blend fabrics are dyed or flame-retardant treated or both dyed and flame-retardant treated using conventional heat dyeing equipment. Octylpyrrolidones, tributyl phosphine oxide and mixtures of N-cyclohexyl-2-pyrrolidone with available dye carriers are used as diffusion-promoting agents for dyes, flame retardant agents or both. Odor-free, flame resistant, colored or colored and highly flame resistant products result.

56 Claims, No Drawings

EXHAUST PROCESS FOR DYEING AND/OR IMPROVING THE FLAME RESISTANCE OF ARAMID FIBERS

CROSS-REFERENCE TO RELATED APPLICATIONS

This application is a continuation-in-part of our earlier application Ser. No. 07/437,397 filed Nov. 16, 1989, now abandoned, which in turn is a continuation-in-part of our earlier application Ser. No. 07/295,001 filed Jan. 9, 1989, now U.S. Pat. No. 4,898,596 which, in turn, is a continuation of earlier application Ser. No. 07/139,761 filed Dec. 30, 1987, now abandoned.

This invention relates to dyeing aramid fibers and simultaneously improving the flame resistance of these fibers. Aramids and aramid blends are dyed and optionally also flame-retardant treated in conventional dyeing equipment to produce an odor-free, colored, flame resistant or colored and highly flame resistant, product.

BACKGROUND OF THE INVENTION

Aramid fibers are highly resistant to heat decomposition, have inherent flame resistance, and are frequently used in working wear for special environments where flame resistance is required. Fabrics made of these fibers are extremely strong and durable, and have been widely adopted for military applications where personnel have the potential to be exposed to fire and flame, such as aircraft pilots, tank crews and the like. There is a need for dyed fabrics that have flame-resistant properties even greater than the undyed fabrics or dyed fabrics. Meta-linked aromatic polyamide fibers (aramid fibers) are made from high-molecular-weight polymers that are highly crystalline and have either a high or no glass transition temperature.

These inherent desirable properties of aramid fibers also create difficulties for fiber processing in other areas; specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths.

Polar organic solvents have also been used to swell the fiber or create voids in the fiber structure to enhance dyeability. These procedures involve solvent exhaust treatments at elevated temperatures with subsequent dyeing. Another source of dyed aramid fiber is solution-dyed aramid yarn, available from the producer, prepared by solution dyeing in which a quantity of dye or pigment is mixed with the molten or dissolved polymer prior to extrusion of the polymer or solution into fine fibers; the dye or pigment becomes part of the fiber structure. Solution-dyed fibers are more costly than the undyed fibers due, in part, to the additional costs of manufacture, and must be used in the color provided by the supplier, leaving the user with only a limited choice of colors. Solution-dyed fibers offer relatively good lightfastness, whereas some undyed aramid fibers, particularly Nomex® (DuPont), yellow following exposure to UV light.

More recently, a process has been described in U.S. Pat. No. 4,525,168 in which acid or anionic dyes are introduced into aramid fibers by coupling the dye to a dye site receptor which, in turn, is attached to the fiber.

The process includes first swelling the fiber in a strong polar solvent and, while the fiber is in the swollen condition, introducing a substance capable of forming a strong chemical bond with an anionic dye into the swollen fiber. This dye site receptor substance is an amine, typically hexamethylenediamine. The procedure described requires at least three steps: first pretreating the fiber in a solution of solvent/swelling agent; treating with the diamine and a wetting agent; then drying to shrink the fiber and incorporate the diamine dye site receptor into the fiber. The thus-pretreated fabric is then dyed with an anionic dye. Aramid fibers described and purported to be successfully dyed in U.S. Pat. No. 4,198,494 are sold under the trademarks Nomex® and Kevlar® by DuPont, and under the trademark Conex® by Teijin Limited of Tokyo, Japan.

A process has been described by Cates and others in commonly-assigned U.S. Pat. No. 4,759,770 for the continuous or semi-continuous dyeing of and simultaneous improving the flame-resistant properties of poly(m-phenyleneisophthalamide) fibers that includes the step of introducing the fiber into a fiber swelling agent solution also containing at least one dye together with at least one flame retardant, thereby swelling the fiber and introducing both the dye and the flame retardant into the fiber while in the swollen state. The flame resistance/performance properties of fabrics dyed by this process are significantly improved. LOI values, as described below, may be as high as 44% for simultaneously dyed and flame retarded T-455 Nomex fabric product produced by the process of this invention. As a means of comparison, undyed T-455 Nomex has an LOI of 27%. However, this process involves some equipment not routinely available on most existing processing lines.

Our earlier U.S. Pat. No. 4,898,596 describes a process for dyeing, flame-retardant treating or both dyeing and flame retardant treating aramid fabrics using N-cyclohexyl-2-pyrrolidone as a dye and/or flame retardant-diffusion promoting agent.

It is an object of the present invention to provide a process for dyeing an aramid fiber such as Nomex®. It is also an object to provide a process for simultaneously dyeing and not detracting from the inherent strength of the aramid fibers. It is also an object to provide a process suitable to conventional equipment such as pressure jets, dye becks or similar machines. It is particularly an object to provide a process for the preparation of dyed, "super FR" Nomex® fabrics of high LOI of 37%–44% as described in the Cates et al U.S. Pat. No. 4,759,770.

In another aspect of the invention we describe the octylpyrrolidones and tributyl phosphine oxide as additional dye diffusion promoting agents found to be at least comparable to and in some instances superior to CHP used by itself in terms of stronger dyeing, improved color and the like. In addition to its dye diffusion promoting ability, tributyl phosphine oxide is itself a flame retardant and thus simultaneously dyes and improves the flame retardancy of the fabric being treated.

The octylpyrrolidone dye diffusion promoting agents may be used with acid, basic, direct, mordant, reactive, pigment and disperse dyes for dyeing Nomex-type fabrics (meta isomer). The combination of an octylpyrrolidone dye diffusion promoting agent and a basic dye stains Kevlar-type aramid fabrics (para isomer) and eliminates "frostiness" of blends of fabrics containing fibers of the para and meta isomers.

Additionally, we describe stronger dyeing and improved color retention achieved with combinations of CHP with conventional dye carriers, such as CHP with ethylene glycol phenyl ether or CHP with butyl/propyl phthalimide.

SUMMARY OF THE INVENTION

Disclosed is a process for dyeing or flame-retardant treating, or if preferred, both dyeing and simultaneously improving the flame-resistant properties of poly(m-phenyleneisophthalamide) fibers. The process includes the steps of introducing the fiber into a fiber dyeing solution containing a tinctorial amount of at least one dye in combination with selected dye carriers or using N-octyl-2-pyrrolidone (NOP) or other effective diffusion promoters as defined below, and, optionally, at least one flame retardant, especially chloroalkyl diphosphate esters such as Antiblaze 100, optionally also containing sodium nitrate, then heating the fiber and solution at a temperature and for a sufficient period of time to dye and flame retardant treat (when flame retardant is present) the fibers.

In another embodiment of the invention, we have discovered the advantages of a two-step process in which a dye diffusion promoting agent such as NOP is applied in an initial step prior to further processing such as dyeing or treating with a flame retardant or both. Initial treatment with a dye diffusion promoting agent such as NOP leaves residual NOP on the aramid fabric which may be sold to processors in this condition for subsequent dyeing and/or flame retardant treating. The separate application of the dye diffusion promoting agent prior to dyeing sometimes results in a better dyeing than does the use of the dye diffusion promoting agent directly with the dye(s) and usually produces higher levels of flame resistance.

The preferred dye diffusion promoting agent, NOP used in this invention is a volatile liquid under some conditions and as such requires caution and care in commercial processing operations. It is convenient to use NOP alone in a separate bath prior to further processing as this allows recovery of the NOP in significant quantities and minimizes atmospheric escape of volatiles. This separate treatment also permits a higher degree of flexibility in further processing; dyebaths, especially aqueous dyebaths, flame retardants, various finishes, etc., may be used all independent of volatile NOP further minimizing escape of volatiles and simplifying solution handling, clean-up and storage. The two-step process allows for the dyeing of fully or partially constructed garments by first treating the fabric with the dye diffusion promoting agent, an effective amount of which remains on the fabric. A garment is then fully or partially constructed and dyed to the appropriate shade.

A carrier in amounts preferably up to 10% by weight may be used in conjunction with the dye diffusing promoter. These carriers are conventionally used in the art and include ethylene glycol phenyl ether (Dowanol EPH) and butyl/propyl phthalimide (Carolid NOL).

Candidate carriers and carriers in combination with CHP were evaluated as follows: A dyebath was prepared using an initial temperature of 54° C. and a liquor-to-goods ratio of 40:1. To the bath was added the carrier (or combination) and 0.5% of dye, usually Basic Blue 77, and the fabric to be dyed was inserted. The bath temperature was raised to 66° C., and 5% of a salt, usually sodium nitrate, was added. The temperature was raised in steps to 71° C., 77° C. and 82° C, and 5% of salt was added at each of the three steps, making a total of 20% salt, based on the weight of fabric. The dyeing vessel was then capped, and the temperature was raised to 130° C. and held at that temperature for 1.5 hours. The bath was then cooled, and the fabric was rinsed thoroughly. The results of these experiments are given in Example I.

Certain ultraviolet absorbers such as Ultrafast 830 when included in the dyeing system produced an improvement of half a grade (on the gray scale) in lightfastness. An additional half grade improvement is usually obtained by a topical post-treatment with a UV absorber.

Another aspect of this invention is that dyeing and flame retardant fixation can be obtained at atmospheric pressure and at temperatures below the boil. Useful color and flame retardant fixation have been achieved at 98° C. with somewhat lower degrees of color fixation when the same treatment was applied at 82° C. These procedures are described in Example V, below. Similar experiments, describing the dyeing of T-455 Nomex with dyes of several different classes, are described in Example II.

In other experiments, dyeing was conducted at at least 100° C. or above, conveniently in the range of about 120° C. to about 150° C., at a pressure above atmospheric and for a time sufficient to achieve the desired coloration, usually from about 15 minutes up to 2 to 3 hours. Time and temperature are related, and we have found best results to be at about 130° C. for a period of about one hour.

Flame retardants are applied in a range of about 3% to about 20% based on weight of fabric for the exemplified flame retardant Antiblaze 100, with a preferred range of from 6% to 15%, and a most preferred range of from 6% to 9%.

An example of a dye diffusion promoting agent which is itself flame retardant is provided by tributyl phosphine oxide (TBPO). Example III describes the use of that dye diffusion promoting agent for dyeing T-455 Nomex. The flame resistance of the dyed fiber was significantly improved by residual TBPO.

We have identified the octylpyrrolidones, specifically N-(n-octyl)-2-pyrrolidone and N-isooctyl-2-pyrrolidone, from among the class of substituted pyrrolidones as in Example VI, and TBPO, as discussed above, as unexpectedly effective dye diffusion promoting agents and of an order at least similar to and in certain experiments superior to CHP used alone.

It will be apparent that variations on this process are possible, such as use of other flame retardants, or other temperatures or times.

Other effective flame retardants suited for use in the process and offering acceptable flame resistance and durability to laundering include halophosphate esters, phosphates and phosphonates of particular types. These include AB-100, a chloroalkyl diphosphate ester, AB-80, a trichloropropylphosphate, and DBBP, a dibutylbutylphosphonate (all products of Albright and Wilson); Fyrol CEF and Fyrol PCF, trichloroethylphosphate and trichloropropylphosphate, and TBP, tributylphosphate (products of Stauffer Chemical Co.), XP 60A and XP 60B, both halophosphate esters (products of Virkler); and HP-36, a halogenated phosphate ester available as a pale yellow, low viscosity liquid containing 35 to 37% bromine, 8–9.5% chlorine and 6–8% phosphorus (a product of Great Lakes Chemical Corporation). The results of trials with these flame retardants are described in Example IV and Table 3.

The flame resistance/performance properties of fabrics dyed by the process of this invention are significantly improved, far better than if aftertreated with a flame-retardant (FR) finish applied from an aqueous solution following the dyeing and fixing operation. Limiting Oxygen Index (LOI) values, as described in more detail below, may be as high as 44% for the simultaneously dyed and flame retarded T-455 Nomex® fabric product produced by the process of this invention. As a means of comparison, undyed T-455 Nomex® has an LOI of 27%.

Both dyeing and flame retarding are affected by the concentration of the dye diffusion promoting agents. As an illustration, we have obtained dye and FR fixation in this process using dye diffusion promoting agent concentrations of 5 to 120 percent on weight of fabric with excellent results at the 20 percent or higher level. Results are also affected by the liquor-to-fabric ratio. Typical liquor-to-fabric ratio for this work has been 15:1, although in production ratios as low as 5:1 may be used with 7:1 considered normal. Residual agent is removed by heating with boiling water. The results of dyeing experiments using a variety of dye diffusion promoting agents are described in Example VI. Particularly noteworthy results were obtained with two octylpyrrolidones.

Fibers suitable for the process of this invention are known generally as aromatic polyamides. This class includes a wide variety of polymers as disclosed in U.S. Pat. No. 4,324,706, the disclosure of which is incorporated by reference. Our experience indicates that not all types of aromatic polyamide fibers can be reproducibly dyed by this process; some fibers are not affected sufficiently by the cyclohexylpyrrolidone or other dye diffusion promoting agents to allow the dye to enter the fiber and are only surface stained, not fully dyed. Thus, the fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Our experience indicates that fibers of the para isomer, poly(p-phenyleneterephthalamide) represented commercially by DuPont's Kevlar® and Enka-Glanzstoff's Arenka®, are usually stained or changed in color but are not dyed by the process of this invention. See, however, Example IX. Accordingly, as used in the text of this application and in the claims that follow, the expressions "aramid" and "aromatic polyamide fiber", when pertaining to the novel process of this invention, will signify the meta isomer unless otherwise specified.

Nomex® T-455, a blend of 95% Nomex and 5% Kevlar, is difficult to dye to a fully acceptable deep, even shade due to the presence of a minor amount of non-dyed para isomer leading to a "frosty" appearance of the dyed goods. We have surprisingly found the specific combination of the octylpyrrolidones with basic dyes effective to significantly stain the para isomer and eliminate "frostiness" of the blended fabric.

A preferred flame retardant is Antiblaze® 100 (Mobil Oil Corp.) CAS registry number 38051-10-4. It has the following structure:

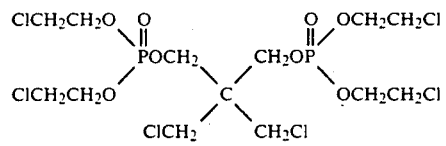

Flame retardant concentrations in the treatment bath from 0.5% to about 20% (based on weight of fabric) are contemplated. However, the upper limit as a practical matter will be determined by the degree of performance required balanced against the cost of the FR chemical or system used. Concentrations in the range of about 3% to about 20% have been shown to be effective in increasing LOI values.

As an assessment of substantivity of the flame retardant and as an indication of durability and washfastness, the phosphorus content of each sample was measured initially and after up to 100 launderings in hot water using a home washing machine and household laundry detergent.

Limiting Oxygen Index (LOI) is a method of measuring the minimum oxygen concentration expressed as volume % needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

DESCRIPTION OF THE PREFERRED EMBODIMENTS

The following examples offered are by illustration and not by way of limitation. All parts and percentages herein are given by weight unless otherwise specified.

EXAMPLE I

We compared the effectiveness of CHP used alone and in combination with various conventional dye carriers. Samples of T-455 Nomex were dyed in an Ahiba Vista-Matic laboratory dyeing unit, using different types and amounts of dye diffusion promoting agents and conventional carriers, alone or in combination. The liquor-to-goods ratio was 40:1. To the bath was added the carrier (or combination) and 0.5% of Basic Blue 77 dye. The bath temperature was raised to 66° C., and 5% of sodium nitrate, based on weight of the fabric, was added. Similar additions of sodium nitrate were made at 71° C., 77° C., and 82° C., making a total of 20% salt. The bath temperature was then raised to 130° C. and held at that figure for 1.5 hours. The bath was then cooled, and the fabric was thoroughly rinsed and then dried.

None of the conventional dye carriers which were screened produced satisfactory dyeing at 130° C. (except for acetophenone, which has undesirable properties). Combinations of conventional carriers with cyclohexylpyrrolidone (CHP) did in some instances produce stronger dyeing and improved color retention then CHP alone. As shown in Table 1, these improvements were noted for Dowanol EPH, an ethylene glycol phenyl ether, and Carolid NOL, a butyl/propyl phthalimide. The data also demonstrate that tributyl phosphine oxide alone functions as an effective dye diffusion promoting agent.

The following conventional carriers proved ineffective in promoting dyeing of the Nomex fabric, either alone or in combination with CHP:

| | |
|---|---|
| DuPont DBE-4: | dimethyl ester of succinic acid |
| Hipochem HMC: | emulsified methyl naphthalene/biphenyl complex |
| Hipochem JET-T: | emulsified trichlorobenzene |
| Carolid J-56: | 2-butoxyethanol |
| Ultrafast 830: | benzophenone derivative |

TABLE 1

Effects of Various Carriers on the Exhaust Dyeing of Nomex

| Dye Diffusion Promoting Agent | | Conventional Carrier | | | Strength of Dyeing[a] | Color Retention[b] |
|---|---|---|---|---|---|---|
| Name | Concn. % | Trade Name | Concn. % | Identification | % | % |
| CHP[c] | 1.6 | None | — | — | Standard | 93 |
| CHP | 1.3 | None | — | — | 24 w | 87 |
| CHP | 1.3 | Dowanol EPH | 1.3 | ethylene glycol phenyl ether | 7 s | 97 |
| CHP | 1.3 | Carolid NOL | .4 | butyl/propyl phthalimide | 12 s | 99 |
| CHP | 1.3 | None | — | — | Standard | 98 |
| CHP | 1.3 | Carolid NOL | .13 | butyl/propyl phthalimide | 6 s | 104 |
| CHP | 1.3 | None | — | — | Standard | 93 |
| TBPO[d] | 1.0 | None | — | — | 8 s | 92 |

[a]Based on KSSUM values
[b]After 25 home laundrings
[c]Cyclohexylpyrrolidone
[d]Tributyl phosphine oxide
w = weaker
s = stronger

EXAMPLE II

Samples of T-455 Nomex (containing 95% Nomex and 5% Kevlar) were dyed in an Ahiba Vista-Matic laboratory dyeing unit, using different classes of dyes. The liquor-to-goods ratio was 20:1, and the dyebath contained 1% of Merpol HCS, 1% of N-(n-octyl)-2-pyrrolidone, and 1, 3, or 5% of dye. The dyebath temperature was raised from 60° C. to 130° C. at 2°-3° C. per minute, and maintained at 130° C. for 1.5 hours. The samples were then cooled, rinsed, scoured in nonionic detergent and soda ash at the boil, and then dried.

Table 2 shows the Lightfastness (after 10 hours of exposure to a carbon arc) and % Color Retention after an AATCC III-A Wash of the dyed samples. The results show that both acid and basic dyes yielded satisfactory lightfastness and washfastness for this type of fiber. It was noted in addition that in those samples dyed with basic dyes, the Kevlar fibers were deeply stained, so that the dyed fabric did not show a "frosty" appearance. All of the dyed samples had wet and dry Crockfastness ratings of 4-5 or 5.

Additional samples were dyed as described above with the following dyes:

| | |
|---|---|
| Acid Blue 158 | Direct Red 81 |
| Acid Blue 179 | Disperse Blue 79 |
| Acid Red 114 | Sodyecron Navy RGLS-N (disperse nonionic) |

The results of these dyeings were similar to those presented in Table 2. Thus, the results show that dyes of various classes can be successfully used in this dyeing procedure.

TABLE 2

Dyeing of Nomex 455 with Acid and Basic Dyes

| Dye | Concentration % | Lightfastness Class | Color Retention % |
|---|---|---|---|
| Acid Yellow 151 | 1 | 4 | 86 |
| | 3 | 4-5 | 92 |
| | 5 | 4-5 | 91 |
| Acid Red 316 | 1 | 2-3 | 94 |
| | 3 | 4 | 92 |
| | 5 | 4-5 | 99 |
| Acid Blue 171 | 1 | 2 | 93 |
| | 3 | 3-4 | 86 |
| | 5 | 4 | 89 |
| Basic Yellow 24 | 1 | 3 | 83 |
| | 3 | 3 | 75 |
| | 5 | 4 | 90 |
| Basic Red 29 | 1 | 3-4 | 67 |
| | 3 | 3-4 | 85 |
| | 5 | 4 | 86 |
| Basic Blue 54 | 1 | 2-3 | 66 |
| | 3 | 3-4 | 94 |

EXAMPLE III

Samples of T-455 Nomex were dyed in an Ahiba Vista-Matic dyeing unit. The liquor-to-goods ratio was 40:1, and the dyebath composition was as follows:

| | |
|---|---|
| Tributyl phosphine oxide (TBPO) | 1.0% |
| Sodium nitrate | 1.25% |
| Basic Blue 77 dye | 0.025% |

The pH of the dyebath was 4.3. Nomex fabric was immersed in the bath, and the temperature was raised to 130° C. and maintained at that temperature for 2 hours. The bath was then cooled, and the fabric was rinsed and dried. The color had been fully exhausted from the bath, and the fabric was dyed to a deep, full shade. After dyeing, the fabric had a Limiting Oxygen Index (LOI)

of 37% and a phosphorus content of 1%, while the corresponding figures after 26 launderings were 32.5% and 0.60%. Typically, untreated Nomex has an LOI of 28.0% and contains no phosphorus.

In an example similar to the above, Type 455 Nomex was successfully dyed with Acid Blue 62 dye.

From the above results, it is apparent that TBPO is an effective dye diffusion promoting agent for Nomex, and it also increases flame resistance of the fiber.

EXAMPLE IV

Candidate carriers, solvents and representative flame retardants were selected and tested in a single, combined exhaust dyeing and flame retardant treating procedure using Nomex type T-455, 20 g at a liquor-to-goods ratio of 20:1 in an Ahiba laboratory dyeing unit. The total mix weight was 400 g. The dye/FR bath was prepared according to the following:

| | | %, owb | %, owf |
|---|---|---|---|
| Carrier or solvent product | 10 g | 2.5 | 50 |
| Flame retardant product | 10 g | 2.5 | 50 |
| Sodium nitrate | 10 g | 2.5 | 50 |
| Basic Blue #77 | 0.2 g | 0.05 | 1 |

Fabric was added to the dyeing mix and agitation begun as heating was started to provide an increase of approximately 3° C./min. The system was brought to 130° C. and held there for 2 hours, then cooled. The fabric was then removed, rinsed and dried prior to testing.

Fabric samples were laundered 25 times in a home laundry machine, then tested for durability of the flame retardant treatment to multiple launderings by measuring LOI values and percent of the active flame retardant moiety (P, Br or Cl) remaining on the fabric. The results obtained are shown in Table 3.

TABLE 3

| FLAME RETARDANTS | | Fabric Properties after 25 launderings | | | |
|---|---|---|---|---|---|
| Product | Chemical Type | LOI % | P % | Br % | Cl % |
| Albright and Wilson | | | | | |
| AB-100 | chloroalkyldiphosphate ester | 41.6 | 0.40 | — | 1.38 |
| AB-80 | trichloropropylphosphate | 37.5 | .27 | — | .98 |
| DBBP | dibutylbutylphosphonate | 35.0 | .27 | 0 | .17 |
| Stauffer | | | | | |
| Fyrol CEF | trichloroethylphosphate | 30.0 | .11 | — | .45 |
| Fyrol PCF | trichloropropylphosphate | 37.5 | .27 | — | .95 |
| TBP | tributylphosphate | 36.2 | .27 | 0 | .17 |
| Virkler | | | | | |
| XP 60A | halophosphate ester | 40.0 | .22 | 0 | .86 |
| XP 60B | halophosphate ester | 40.0 | .27 | .43 | .45 |
| Great Lakes | | | | | |
| HP-36 | halogenated phosphate ester | 40.0 | .32 | .41 | .50 |

Using cyclohexylpyrrolidone (CHP) as the carrier, flame retardants were durably fixed and color was developed. Water soluble flame retardants did not fix to the Nomex. Among the carriers or solvents tested, CHP provided superior fixation and color yield.

EXAMPLE V

A dyebath was prepared from:

| | |
|---|---|
| Ethylene diamine diacetic acid sequestrant | 0.5% owf |
| Formic acid | 1.0% |
| Promex Blue A6G (acid dye) | 2.0% |

These ingredients were weighed, dissolved in hot water, and added to a 400 ml dyeing tube of an Ahiba dyeing machine. Separately, 20 g of a carrier/flame retardant solution (containing 87.5 parts of CHP to 12.5 parts of AB 100) was diluted with three volumes of water and then added to the dyeing tube. The volume of liquid in the tube was then raised to 400 ml. The fabric, weighing approximately 22 g, was then added to the bath and the tube was placed in the Ahiba heating chamber with agitation. The dyebath temperature was raised to the required temperature, and kept there for one hour. Finally, the dyed, flame-retarded samples were removed, rinsed and scoured.

Acceptable dyeing and durable flame resistance were obtained at temperatures in the range of 93° C. to 115° C. Data in Table 4 show good durability of flame resistance (as measured by phosphorus content) through 50 launderings. Also indicative of effectiveness of low temperature treatments is the durability of phosphorus applied from baths at 82° C. and above. At those temperatures, good durability of phosphorus content was found, as indicated by the data in Table 4.

In Table 5, % Retn. or % retention is the color retained after high-temperature scouring. % Endur. or % endurance is the color retained after 25 and 50 launderings. Color difference values are based on scoured samples. The results in Table 5 show that treatments applied at 82° C. or higher had good color retention and excellent color endurance. Compared to the 115° C. dyeing, color strength differences were small for all except the 82° C. dyeing, indicating less dye uptake at this temperature.

TABLE 4

| | Phosphorus Contents | | | |
|---|---|---|---|---|
| Dyeing Temp., °C. | % P, Dyed | % P, Scoured | % P after 25 La. | % P after 50 La. |
| 82 | 0.39 | 0.30 | 0.28 | 0.30 |
| 93 | .42 | .31 | .29 | .29 |
| 104 | .40 | .31 | .30 | .31 |
| 115 | .42 | .31 | .30 | .32 |

TABLE 5

| | Color Data | | | |
|---|---|---|---|---|
| Dyeing Temp., °C. | % Retn., Scoured | % Endur., 25 La. | % Endur., 50 La. | % Strength |
| 82 | 84 | 90 | 92 | 36 w |
| 93 | 94 | 89 | 89 | 2 w |
| 104 | 97 | 97 | 93 | 3 s |
| 115 | 96 | 92 | 93 | STD |

EXAMPLE VI

Samples of T-455 Nomex (containing 95% Nomex and 5% Kevlar) were dyed in an Ahiba Vista-Matic laboratory dyeing unit, using different classes of dyes. The liquor-to-goods ratio was 40:1, and the dyebath composition was as follows:

| | |
|---|---|
| Proquest 100 chelating agent | 0.5% owf |
| Formic acid | 1.0% |
| Promex AG acid dye | 2.0% |
| Dye diffusion promoting agent | 25 g/liter |

The temperature was raised to 130° C. and maintained at that figure for 1-2 hours, typically one hour. The fabric samples were then scoured 15 minutes in water and dried. The results were evaluated both by the color of the dyed specimens and the degree of exhaustion of the bath. Dyeings were performed using a series of candidate dye diffusion promoting agents, all of them pyrrolidones. Dyeings performed with N-(n-octyl)-2-pyrrolidone (NOP) and N-isooctyl-2-pyrrolidone at 5 g/l to 25 g/l yielded full deep blue shades on the fabric and good bath exhaustion. The results were superior to those obtained with cyclohexylpyrrolidone (CHP) under comparable conditions. Dyeings performed with NOP gave a deep shade even when its concentration in the bath was reduced to 5 g/liter, equivalent to 20% owf. We have not found this level of efficiency in any other dye diffusion promoting agent, including CHP. When Antiblaze 100 was included in the formulation, an add-on of phosphorus was obtained which was durable to repeated launderings.

The use of N-benzyl-2-pyrrolidone as the dye diffusion promoting agent yielded a lightly dyed fabric and poor bath exhaustion.

Additional dyeing experiments were performed with the following candidate dye diffusion promoting agents:

Stearamidopropyl pyrrolidonyl dimethyl ammonium chloride
N-cocoalkylpyrrolidone
N-cocoamidoalkylpyrrolidone
Hydrogenated tallowalkyl pyrrolidone
N-dodecyl-2-pyrrolidone
N-phenyl-2-pyrrolidone
N-methyl-2-pyrrolidone
N-ethyl-2-pyrrolidone
N-butyl-2-pyrrolidone All of these candidate dye diffusion promoting agents were essentially ineffective in promoting dyeing under the conditions described above.

EXAMPLE VII

Samples of T-455 Nomex were dyed at different temperatures in an Ahiba Vista-Matic laboratory dyeing unit, using 10 g/L of N-(n-octyl)-2-pyrrolidone (NOP) as the dye diffusion promoting agent. The dyeing procedure was as follows: To 200 mL of water at 60° C. was added 0.4 g of Glauber's salt, 2 g of NOP and 0.1 g of Basic Blue 54 dye, equivalent to 1% of dye based on the fabric weight. A 10 g sample of fabric was added, and the bath temperature was raised at 2°-3° C. per minute to 70°, 85°, 100° or 105° C. and maintained at temperature for one hour. The fabric was then cooled, rinsed, and afterscoured at the boil for 2-3 min. in a bath containing 0.5 g/L of NID nonionic detergent and 0.5 g/L of soda ash. The fabric was then dried.

The results of color measurements are shown in Table 6. Dyeing was achieved at all temperatures, but an obvious shade difference was seen below 85° C. Color retention after scouring was 83% when dyeing was performed at 70° C., and approximately 100% at higher temperatures. The percent endurance was also lower at 70° C.

It is clear from these results that satisfactory dyeing of Nomex 455 can be conducted at temperatures significantly below the boil when NOP is used as the dye diffusion promoting agent.

TABLE 6

Dyeing of Nomex 455 with Basic Blue 54. Using Various Dyeing Temperatures and NOP* Dye Diffusion Promoting Agent

| Dyeing Temp. °C. | % Retn., Scoured | % Endur., 25 Laund. | Color, % Strength |
|---|---|---|---|
| 70 | 83 | 83 | 43 w |
| 85 | 117 | 98 | 21 w |
| 100 | 100 | 93 | 17 w |
| 105 | 103 | 104 | STD |

*N-(n-octyl)-2-pyrrolidone

EXAMPLE VIII

Samples of T-455 Nomex were dyed at 130° C. for one hour, using the procedure described in Example VII. In this Example, however, different mixtures of NOP and CHP were used as dye diffusion promoting agents, as shown in columns 1 and 2 of Table 7. As can be seen from these results, no significant advantage was obtained by mixing NOP and CHP. Satisfactory dyeing was obtained in all cases, and NOP alone was most effective in promoting dyeing.

While the results in Table 7 are for Basic Blue 54, similar results were obtained with a number of acid dyes.

TABLE 7

Dyeing of Nomex 455 With Basic Blue 54 Using Different Proportions of NOP* and CHP**

| NOP Concn. g/L | CHP Concn. g/L | % Retn., Scoured | % Endur., 25 Laund. | Color, % Strength |
|---|---|---|---|---|
| 15.0 | 0.0 | 107 | 108* | STD |
| 11.3 | 10.0 | 98 | 103 | 0.6 s |
| 7.5 | 20.0 | 102 | 103 | 2.4 w |
| 3.8 | 30.0 | 104 | 102 | 5.1 w |
| 0.0 | 40.0 | 103 | 100 | 4.3 w |

*N-(n-octyl)-2-pyrrolidone
**Cyclohexylpyrrolidone

EXAMPLE IX

In an attempt to obtain superior dye coverage of the 5% Kevlar content of Nomex 455, a combination of acid and basic dyes was employed, using a nonionic anti-precipitant to promote compatibility of the dyes. The dyeing procedure was as follows: To 200 mL of water at 50° C. was added 0.7 g of an ethoxylated tallow amine anti-precipitant 0.6 g of Glauber's salt, and 2 g of NOP. A 10 g sample of Nomex® 455 was added, the bath was agitated for 5 minutes, and 0.2 g of Acid Blue 62 dye was added, followed by agitation for 5 minutes. To the bath 0.15 g of Basic Blue 54 dye was then added, and the pH was adjusted to 5.0 with acetic acid, followed again by 5 minutes of agitation. The bath temperature was then raised at 2° C. per minute to 130° C., and held at that temperature for 1.5 hours. The dyed fabric was rinsed, scoured at the boil for 2 minutes in a solution of 0.5 g/L nonionic detergent and 0.5 g/L; of soda ash, rinsed, and dried.

The fabric was dyed to a solid, uniform blue shade, and showed no frosty appearance, indicating good coverage of both the Nomex and Kevlar fibers.

EXAMPLE X

Samples of T-455 Nomex (containing 95% Nomex and 5% Kevlar) weighing 153 g/m$^2$ were dyed in an Ahiba Vista-Matic laboratory dyeing unit, using a two step dyeing procedure. In Step A, the samples were pretreated in a 20:1 bath containing 88 g/liter of N-(n-octyl)-2-pyrrolidone (NOP). Treatment was carried out for 30 minutes at 66° C., after which the sample was cooled, rinsed in tap water, and air dried at room temperature. The purpose of Step A was to impregnate the Nomex fabric with NOP to promote subsequent dyeing.

In Step B, the dried sample from Step A was dyed in a 40:1 bath containing 0.5% of Proquest 100 sequestering agent, 1.0% of formic acid, and 2.0% of Acid Blue 62, all percentages based on the weight of the fiber. Dyeings were carried out for two hours at 93° C. and for one hour at 130° C., respectively. The dyed samples were washed in a hot solution of 0.1% nonionic detergent and 1% of soda ash, rinsed in water and air dried.

Both the samples dyed at 93° C. and at 130° C. were colored to a medium blue, with little variation in shade.

EXAMPLE XI

The experiments of EXAMPLE X were repeated, except that 12 g/liter of Antiblaze 100 flame retardant was added to the bath in Step A. The purpose of these experiments was to determine whether flame resistance could be imparted to the Nomex fabrics in a separate step before dyeing. Dyeing was carried out in Step B as described in EXAMPLE X.

Both the samples dyed at 93° C. and at 130° C. were colored to a medium blue, with little variation in shade. The samples dyed at 93° C. and at 130° C. contained 0.08% and 0.13% of phosphorus, respectively. Both of these levels of phosphorus content indicate a slight enhancement of flame resistance.

EXAMPLE XII

Samples of T-455 Nomex (containing 95% Nomex and 5% Kevlar) were dyed in an Ahiba Vista-Matic dyeing unit, using a two-step dyeing procedure. In Step A, the samples were pretreated in a 20:1 bath containing 15 g/liter of NOP. Treatment was carried out for 1.5 hours at 130° C., after which the samples were cooled, rinsed in tap water, and air dried at room temperature.

In Step B, the dried sample from Step A was dyed in a 20:1 bath containing 1% of wetting agent and 1% of Acid Blue 113 for 1.5 hours at 99° C. and 116° C., respectively. The dyed samples were washed in a boiling solution containing 0.1% of nonionic agent and 1% of soda ash, rinsed in water, and air dried.

Both the samples dyed at 99° C. and at 116° C. were colored a dark blue, with little variation in shade, the sample dyed at the higher temperature showing a higher color yield. Both samples had % Retention values of 96%.

EXAMPLE XIII

The experiments of EXAMPLE XII were repeated, except that 5 g/liter of Antiblaze 100 was added to the bath in Step A.

Both the samples dyed at 99° C. and 116° C. were colored a dark blue, with no unevenness of shade. The dyed samples showed % Retention values between 97% and 103%, indicating very high durability to scouring.

EXAMPLE XIV

Samples of T-455 Nomex weighing 153 g/m$^2$ were screen printed by a two-step procedure, first treating the fabric with NOP to promote subsequent printing. In Step A, the samples were pretreated in a 20:1 bath containing 15 g/liter of NOP. Treatment was carried out for 1.5 hours at 130° C., after which the samples were cooled, rinsed in tap water, and air dried at room temperature.

In Step B, the dried samples from Step A were screen printed by a conventional means using a printing paste containing 3% of Carbopol 820 solids and 1% of Acid Blue 113 dye. The printed fabrics were dried at 104° C. for 3 minutes, and then fixed by one of the following methods:

1. Saturated steaming at 100° C. and 100% relative humidity for 5 minutes.
2. High temperature steaming at 170° C. and 100% relative humidity for 5 minutes.
3. Autoclaving, by preheating for one cycle; prevacuuming for 7 minutes; steaming at 132° C. for one hour; and post-vacuuming for 7 minutes.

The printed, fixed fabrics were then washed and dried before evaluating their colors.

All of the printed samples had a uniform blue color, but the autoclaved samples were much stronger in color than the samples fixed with saturated steam and especially those fixed with high-temperature steam. The autoclaved samples also had the highest color retention after scouring (87%), followed by the samples set in saturated steam (22%) and high-temperature steam (19%).

If Step A is omitted, the Nomex fabric is stained to a light blue color, rather than being printed to a wash-resistant dark blue shade.

EXAMPLE XV

The experiments described in EXAMPLE XIV were repeated, except that 50 g/liter of the flame retardant Antiblaze 19T was added to the print paste. The presence of this flame retardant had little effect on the color or % Retention of color after scouring.

EXAMPLE XVI

The experiments described in EXAMPLE XIV were repeated, except that 5 g/liter of the flame retardant Antiblaze 100 was included in Step A, the pretreatment. Fixation of the printed color was performed by saturated steaming and autoclaving, as described in EXAMPLE XIV.

The samples fixed by autoclaving were printed a dark, solid blue shade, and had 82% Retention of color after scouring. The samples fixed with saturated steam were substantially weaker in color, and had a % Retention value of only 28%.

If Step A is omitted, the Nomex fabric is only stained after scouring. If acetophenone at a concentration of 60 g/liter is used as the dye after autoclaving is only 40%.

EXAMPLE XVII

A series of experiments was conducted to examine the effects of mixing CHP and NOP as a dye diffusion promoting agents. The experiments were carried out as in EXAMPLE XI, except that NOP/CHP ratios of 1:1 to 1:4 were used, as well as NOP alone and CHP alone. Little advantage was found in the use of such mixtures, either in respect to fixation of phosphorus, % Retention of color after scouring, or depth of shade.

What is claimed is:

1. A process of dyeing poly(m-phenyleneisophthalamide) fabric comprising:
   (1) dyeing the fabric at a temperature in the range of about 100° C. to about 150° C. and elevated pressure in a fiber-dyeing solution containing a tinctorial amount of at least one dye and a dye diffusion promoting amount of an N-octyl-2-pyrrolidone, then
   (2) heating the fabric while in contact with the solution until the desired degree of dyeing is attained.

2. The process of claim 1, in which the dye diffusion promoting agent is N-(n-octyl)-2-pyrrolidone or N-isooctyl-2-pyrrolidone.

3. The process of claim 1, in which the dye is an acid, basic, direct, mordant, reactive, pigment or disperse dye.

4. The process of claim 1, in which the amount of dye diffusion promoting agent is from about 5 to 120 percent by weight of fabric.

5. The process of claim 4, in which the ratio of dyeing solution to fabric is from about 40:1 to about 4:1 by weight.

6. The process of claim 1, including the additional step of (3) removing any residual N-octyl-2-pyrrolidone.

7. The process of claim 1, in which the fabric is dyed at a temperature of about 130° C.

8. The process of claim 1, in which the fabric is dyed for about 15 minutes to about 2 hours.

9. The process of claim 1, in which the fabric is a blend of poly(m-phenyleneisophthalamide) and poly(p-phenyleneterephthalamide) fibers, and the dye is a basic dye.

10. A process of dyeing a blend of poly(m-phenyleneisophthalamide) and poly(p-phenyleneterephthalamide) fibers comprising:
   (1) treating the fibers at a temperature in the range of about 100° C. to about 150° C. and elevated pressure in a solution containing a tinctorial amount of a basic dye and a dye diffusion promoting amount of an N-octyl-2-pyrrolidone, then
   (2) heating the fabric in the solution, until the poly(m-phenyleneisophthalamide) fibers have been dyed and the poly(p-phenyleneterephthalamide) fibers have been stained.

11. The process of claim 10, in which the fabric is a blend of up to 10% by weight poly(p-phenyleneterephthalamide) fibers, balance poly(m-phenyleneisophthalamide) fibers.

12. The process of claim 10 or 11, in which the dye diffusion promoting agent is N-(n-octyl)-2-pyrrolidone or N-(isooctyl)-2-pyrrolidone.

13. The process of claim 12, in which the fabric is treated at a temperature of about 130° C.

14. The process of claim 10, in which the fabric is treated for about 15 minutes to about 2 hours.

15. A process of flame-retardant treating poly(m-phenyleneisophthalamide) fabric comprising:
   (1) flame-retardant treating the fabric at a temperature in the range of about 100° C. to about 150° C. and elevated pressure in a fiber-treating solution containing a flame-retarding amount of at least one flame retardant and a flame-retardant diffusion promoting amount of an N-octyl-2-pyrrolidone, then,
   (2) heating the fabric while in contact with the solution until the desired degree of flame retardant fixation is attained.

16. A process of simultaneously dyeing and flame-retardant treating poly(m-phenyleneisophthalamide) fabric comprising:
   (1) dyeing and flame-retardant treating the fabric at a temperature in the range of about 100° C. to about 150° C. and elevated pressure in a fiber-treating solution containing a tinctorial amount of at least one dye, a flame-retarding amount of at least one flame retardant and a diffusion promoting amount of an N-octyl-2-pyrrolidone, then
   (2) heating the fabric while in contact with the fiber-treating solution until the desired degree of dyeing or flame resistance or both is attained.

17. The process of claims 15 or 16, in which the diffusing promoting agent is N-(n-octyl)-2-pyrrolidone or N-isooctyl-2-pyrrolidone.

18. The process of claims 15 or 16, in which the amount of diffusion promoting agent is from about 5 to about 120 percent by weight of fabric.

19. The process of claim 18, in which the ratio of treating solution to fabric is from about 40:1 to about 4:1 by weight.

20. The process of claims 15 or 16, including the additional step of (3) removing any residual N-octyl-2-pyrrolidone.

21. The process of claims 15 or 16, in which the fabric is treated in step (1) at a temperature of about 130° C.

22. The process of claim 15 or claim 16, in which the fabric is treated in step (1) for about 15 minutes to about 2 hours.

23. The process of claim 16, in which the fabric is a blend of poly(m-phenyleneisophthalamide) and poly(p-phenyleneterephthalamide).

24. A process of dyeing poly(m-phenyleneisophthalamide) fabric comprising:
   (1) dyeing the fabric at a temperature of from about 70° C. to about 100° C. at atmospheric pressure in a fiber-treating solution containing a tinctorial amount of at least one dye and a dye diffusion promoting amount of an N-octyl-2-pyrrolidone, then
   (2) heating the fabric while in contact with the treating solution until the desired degree of dyeing is attained.

25. The process of flame-retardant treating poly(m-phenyleneisophthalamide) fabric comprising:
   (1) flame-retardant treating the fabric at a temperature of about 70° C. to about 100° C. at atmospheric pressure in a fiber-treating solution containing a flame-retarding amount of at least one flame retardant and a diffusion promoting amount of an N-octyl-2-pyrrolidone, then
   (2) heating the fabric while in contact with the treating solution until the desired degree of flame retardant fixation is attained.

26. A process for simultaneously dyeing and flame-retardant treating poly(m-phenyleneisophthalamide) fabric comprising:
   (1) dyeing and flame-retardant treating the fabric at a temperature of about 70° C. to about 100° C. at atmospheric pressure in a fiber-treating solution containing a tinctorial amount of at least one dye, a flame-retarding amount of at least one flame retardant and a diffusion-promoting amount of an N-octyl-2-pyrrolidone, then (2) heating the fabric while in contact with the treating solution until the desired degree of dyeing or flame resistance or both is attained.

27. The process of claims 24, 25 or 26, in which the diffusion promoting agent is N-(n-octyl)-2-pyrrolidone or N-(isooctyl)-2-pyrrolidone.

28. The process of claims 24, 25 or 26, in which the amount of diffusion promoting agent is from about 5 to about 120 percent by weight of fabric.

29. The process of claim 28, in which the ratio of treating solution to fabric is from about 40:1 to about 4:1 by weight.

30. The process of claims 24, 25 or 26, including the additional step of (3) removing any residual N-octyl-2-pyrrolidone.

31. The process of claims 24, 25 or 26, in which the fabric is treated in step (1) for about 15 minutes to about 2 hours.

32. The process of claims 24, 25 or 26, in which the fabric is a blend of poly(m-phenyleneisophthalamide) and poly(p-phenyleneterephthalamide) and/or polybenzimidazole fibers.

33. A process of dyeing poly(m-phenyleneisophthalamide) fabric comprising:

(1) dyeing the fabric at elevated temperature and pressure in a fiber-dyeing solution containing a tinctorial amount of at least one dye and as a dye diffusion promoting system a dye diffusion promoting amount of (a) N-cyclohexyl-2-pyrrolidone and (b) an ethylene glycol phenyl ether or a butyl/propyl phthalimide, then (2) heating the fabric while in contact with the solution until the desired degree of dyeing is attained.

34. The process of claim 33, in which the amount of the dye diffusion promoting system is from about 5 to about 120 percent by weight of fabric.

35. The process of claim 34, in which the ratio of dyeing solution to fabric is from about 40:1 to about 4:1 by weight.

36. The process of claim 34, including the additional step of (3) removing any residual dye diffusion promoter.

37. The process of claim 33, in which the fabric is dyed at a temperature in the range of about 100° C. to about 150° C.

38. The process of claim 37, in which the fabric is dyed for about 15 minutes to about 2 hours.

39. An exhaust process for simultaneously dyeing and improving the flame resistance of aramid fibers, comprising the steps of:

(1) dyeing at elevated temperature and pressure poly(m-phenyleneisophthalamide) fibers in a dyeing solution containing a tinctorial amount of at least one dye and tributyl phosphine oxide, then (2) heating the solution while in contact with the fiber and maintaining contact with the dyeing solution until the desired degree of dyeing or flame resistance or both has been attained, and finally (3) rinsing the fibers.

40. The process of claim 39, in which the ratio of dyeing solution to fabric in step (1) is from about 40:1 to about 4:1 by weight.

41. The process of claim 40, in which the fabric is dyed and flame retardant treated in step (1) at a temperature in the range of about 100° C. to about 150° C.

42. The process of claim 41, in which the fabric is treated in step (1) for about 15 minutes to about 2 hours.

43. A fabric having a Limiting Oxygen Index (ASTM D-2863-77) of greater than 27% in which the poly(m-phenyleneisophthalamide) fibers have been simultaneously dyed and flame-retardant treated by the process of claim 40.

44. A process of dyeing poly(m-phenyleneisophthalamide) fabric comprising:

(1) applying to a poly(m-phenyleneisophthalamide) textile fabric a dye- and/or flame-retardant diffusion promoting amount of N-octyl-2-pyrrolidone;

(2) dyeing the fabric at a temperature of about 100° C. to about 150° and elevated pressure in a fiber-dyeing solution containing a tinctorial amount of at least one dye, then (3) heating the fabric while in contact with the solution until the desired degree of dyeing is attained.

45. A process of flame-retardant treating poly(m-phenyleneisophthalamide) fabric comprising:

(1) applying to the textile fabric a flame-retardant diffusion promoting amount of N-octyl-2-pyrrolidone;

(2) flame-retardant treating the fabric at a temperature of about 100° C. to about 150° C. and elevated pressure in a fiber-treating solution containing a flame-retarding amount of at least one flame retardant, then, (3) heating the fabric while in contact with the solution until the desired degree of flame retardant fixation is attained.

46. A process of flame-retardant treating and dyeing poly(m-phenyleneisophthalamide) fabric comprising:

(1) flame-retardant treating the fabric in a solution containing a flame-retarding amount of at least one flame retardant and a diffusion-promoting amount of an N-octyl-2-pyrrolidone, (2) dyeing the fabric of step (1) at a temperature of about 100° C. to about 150° C. at elevated pressure in a solution containing a tinctorial amount of at least one dye, then (3) heating the fabric while in contact with the solution until the desired degree of dyeing or flame resistance or both is attained.

47. The process of claims 44, 45 or 46, in which the dye diffusion promoting agent is N-(n-octyl)-2-pyrrolidone or N-isooctyl-2-pyrrolidone.

48. The process of claims 44 or 46, in which the dye is an acid, basic, direct, mordant, reactive, pigment or disperse dye.

49. The process of claims 44, 45 or 46, in which the amount of diffusion promoting agent is from about 5 to about 120 percent by weight of fabric.

50. The process of claim 49, in which the ratio of treating solution to fabric is from about 40:1 to about 4:1 by weight.

51. The process of claims 44, 45 or 46, including the additional step of (3) removing any residual N-octyl-2-pyrrolidone.

52. The process of claims 44 or 46, in which the fabric is dyed for about 15 minutes to about 2 hours.

53. The process of claims 44 or 46, in which the fabric is a blend of poly(m-phenyleneisophthalamide) and poly(p-phenyleleterephthalamide) fibers, and the dye is a basic dye.

54. The process of claim 44, in which the dyebath also contains tributylphosphine oxide.

55. A dyebath for simultaneously dyeing and flame retarding poly(m-phenyleneisophthalamide) textile fabrics consisting essentially of:

(1) a tinctorial amount of at least one dye; and
(2) 0.6% to 30% of an N-octyl-2-pyrrolidone, based on the weight of the dyebath, as a dye diffusion promoting agent; and
(3) 0.05% to 5%, based on the weight of the dyebath, of a neutral chloroalkyl diphosphate ester flame retardant.

56. A dyeing and flame retarding assistant which on dilution with water provides a concentration of an N-octyl-2-pyrrolidone of 0.6% to 30%, based on the weight of the dyebath, as a dye diffusion promoting agent, and a concentration of 0.05% to 5% of a neutral chloroalkyl diphosphate ester retardant, and which with the addition of a tinctorial amount of at least one dye provides a dyebath suitable for simultaneously dyeing and flame retarding poly(m-phenyleneisophthalamide) textile fabrics.

* * * * *